US007760142B2

(12) United States Patent
Sabet et al.

(10) Patent No.: US 7,760,142 B2
(45) Date of Patent: Jul. 20, 2010

(54) VERTICALLY INTEGRATED TRANSCEIVER ARRAY

(75) Inventors: Kazem F. Sabet, Ann Arbor, MI (US); Linda P. B. Katehi, Zionsville, IN (US); Alexandros Margomenos, Ann Arbor, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 507 days.

(21) Appl. No.: 11/733,564

(22) Filed: Apr. 10, 2007

(65) Prior Publication Data

US 2008/0252521 A1 Oct. 16, 2008

(51) Int. Cl.
*H01Q 1/38* (2006.01)

(52) U.S. Cl. ..... 343/700 MS

(58) Field of Classification Search ..... 343/700 MS, 343/770, 702, 846, 848, 853; 342/368
See application file for complete search history.

(56) References Cited

U.S. PATENT DOCUMENTS 6,421,013 B1 * 7/2002 Chung ..... 343/700 MS
6,646,609 B2 * 11/2003 Yuasa et al. ..... 343/700 MS
6,710,744 B2 * 3/2004 Morris et al. ..... 343/700 MS
7,239,219 B2 * 7/2007 Brown et al. ..... 333/156
7,460,060 B2 * 12/2008 Aoki ..... 342/179
2005/0190101 A1 * 9/2005 Hiramatsu et al. ..... 342/175
2006/0256018 A1 * 11/2006 Soler Castany et al. ..... 343/700 MS

* cited by examiner

*Primary Examiner*—Huedung Mancuso
(74) *Attorney, Agent, or Firm*—John A. Miller; Miller IP Group, PLC

(57) ABSTRACT

A transceiver array that employs vertically integrated circuits in one or more wafers. The array includes a digital wafer having digital circuits. A plurality of RF cubes are formed to the digital wafer, where each RF cube includes an antenna wafer and at least one lower wafer, and where each RF cube represents a separate channel of the array. The antenna wafer includes a patch antenna and a resonating cavity. The at least one lower wafer includes high frequency RF integrated circuits and intermediate frequency RF integrated circuits. The array has application as a front-end for a digital beam-forming system.

31 Claims, 4 Drawing Sheets

VERTICALLY INTEGRATED TRANSCEIVER ARRAY

BACKGROUND OF THE INVENTION

1. Field of the Invention

This invention relates generally to a transceiver array employing beam-forming and, more particularly, to a transceiver array employing digital beam-forming that includes a plurality of vertically integrated semiconductor wafers.

2. Discussion of the Related Art

Transceiver arrays are widely used in wireless communications, radar applications and sonar applications. A transceiver array is an array of transceiver channels each including an antenna where the channels combine to provide a directional beam for both transmitting and receiving purposes, including beam scanning. As the directivity of the array increases, the gain of the array also increases.

Various types of transceiver arrays are known in the art that provide beam steering. One known transceiver array type includes mounting individual transceiver front-end channels on a mechanical device that moves to provide beam steering or scanning.

Another known transceiver array type is a phased array. A typical phased array includes an antenna in each channel that is connected to a phase shifter, and a power combiner for adding the signals together from the antennas. The phase shifters control either the phase of the excitation current of the antenna for transmission or the phase of the receive signals. When the signals are combined, a beam is formed in a particular direction. Particularly, a transmit beam is formed in space, and a receive beam adds coherently if the signals are received from a particular region of space. The radiation pattern of the transceiver array is determined by the amplitude and phase of the current at each of the antennas. If only the phase of the signals is changed and the amplitude of the signals is fixed, the beam can be steered.

The known transceiver arrays of these types are typically expensive, bulky, consume a relatively large amount of power, etc.

In order to alleviate some of the disadvantages of the known transceiver arrays, digital beam-forming systems have been developed in the art that eliminate the need for the phase shifters to provide beam steering. The digital beam-forming systems digitally provide beam steering. One advantage of digital beam-forming is that once the RF information from each channel is captured in the form of a digital stream, digital signal processing techniques and algorithms can be used to process the data in the spatial domain.

Digital beam-forming is based on the conversion of the RF signal at each antenna into two streams of binary base-band signals representing in-phase and quadrature-phase channels. The digital base-band signals represent the amplitude and phases of signals received at each antenna in the array. The beam-forming is provided by weighting each digital signal from the channels, thereby adjusting their amplitude and phase so that when they are added together they form the desired beam. Thus, the linear phase weight applied to the digitized signal at each channel can make the antenna beam appear as if it is steered to different angular directions.

FIG. 1 is a schematic block diagram of a known transceiver array 10 including a plurality of channels 12 where the array 10 employs digital beam-forming. Each channel 12 includes an antenna 14 that transmits the signal at the desired frequency or receives a receive signal. A transmit/receive module 16 is electrically coupled to the antenna 14 and operates in both a transmit mode and a receive mode. As is well understood in the art, the transmit/receive module 16 includes various components to perform the transmit and receive functions, such as low noise amplifiers (LNA) for amplifying the receive signal, power amplifiers for amplifying the transmit signal, a mixer for converting the transmit signal from an intermediate frequency signal to a high frequency signal and converting the receive signal from a high frequency signal to an intermediate frequency signal, and various filters for filtering the desired frequency, such as band-pass filters and low pass filters. The array 10 also includes an analog-to-digital converter (A/D) 18 that converts the receive signal to a digital signal. A digital-to-analog converter would also be provided to convert the digital transmit signal to an analog signal. The transmit and receive signals are weighted by a weighting junction 20 to provide the beam-forming, and the signal from each channel 12 is summed by a summer 22. A digital signal processor 24 provides the digital signal processing.

As mentioned above, each transmit/receive module 16 includes a plurality of components. Typically, the components in the transmit/receive module 16 are discrete integrated circuit components mounted to a printed circuit board. Because so many components are required in the transmit/receive module 16, the size of the array 10, the component insertion losses and power consumption are significant.

SUMMARY OF THE INVENTION

In accordance with the teachings of the present invention, a transceiver array is disclosed that employs vertically integrated circuits in one or more wafers. The array includes a digital wafer having digital circuits. A plurality of RF cubes are formed to the digital wafer, where each RF cube includes an antenna wafer and at least one lower wafer, and where each RF cube represents a separate channel of the array. The antenna wafer includes a patch antenna and a resonating cavity. The at least one lower wafer includes high frequency RF integrated circuits and intermediate frequency RF integrated circuits. The array has application as a front-end for a digital beam-forming system.

Additional features of the present invention will become apparent from the following description and appended claims, taken in conjunction with the accompanying drawings.

DETAILED DESCRIPTION OF THE EMBODIMENTS

The following discussion of the embodiments of the invention directed towards a transceiver array that employs digital beam-forming and includes vertically integrated RF channels is merely exemplary in nature, and is in no way intended to limit the invention or its applications or uses.

Figure 2:
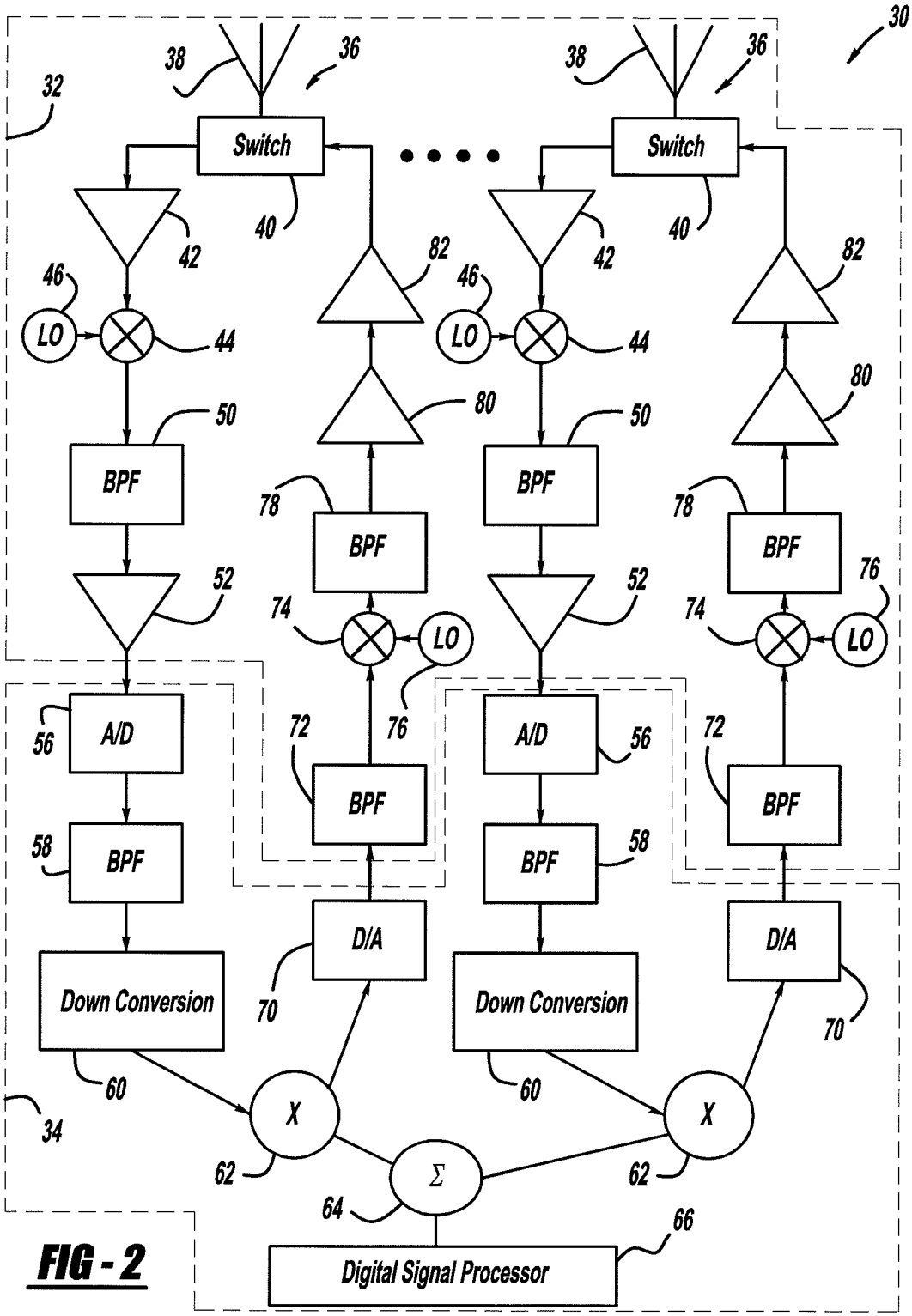
FIG. 2 is a schematic block diagram of a transceiver array that includes vertically integrated semiconductor wafers, according to an embodiment of the present invention.

FIG. 2 is a schematic block diagram of a transceiver array 30 including one or more vertically integrated RF wafers 32 and a digital beam-forming wafer 34. The wafers 32 and 34 are semiconductor wafers, and typically will be silicon, although other semiconductor wafers may also be applicable, such as GaAs, InP, etc. The array 30 includes a plurality of channels 36, two of which are shown, each including an antenna 38. The antenna 38 receives signals or transmits signals depending on whether a switch 40 puts the channels 36 in a receive mode or a transmit mode. In one embodiment, the switch 40 is a microelectro-mechanical switch (MEMS).

On the receiver side of the channel 36, the receive signal is amplified by a low noise amplifier (LNA) 42. The amplified receive signal from the LNA 42 is sent to a mixer 44 that down-converts the high frequency receive signal to an intermediate frequency (IF) signal. The mixer 44 receives a mixer signal from a local oscillator (LO) 46 to provide the frequency down-conversion. In one non-limiting embodiment, the receive signal is about 22 GHz and the IF signal is about 2.4 GHz. The IF signal from the mixer 44 is then sent to a band-pass filter 50 that filters the IF signal to be within a particular frequency band. The filtered signal from the band-pass filter 50 is then amplified by an IF amplifier 52.

The IF signal is then sent to an analog-to-digital (A/D) converter 56 in the digital wafer 34 that converts the analog signal to a digital signal for digital signal processing. The digital signal from the A/D converter 56 is then filtered by a band-pass filter 58, and down-converted to a base-band signal suitable for digital beam-forming by a digital down-conversion device 60. The digital base-band signal is then applied to a weighting junction 62 that weights the signal for beam-forming and beam steering purposes in a manner that is well understood to those skilled in the art. All of the weighted signals from all of the channels 36 are added by a summer 64, and the combined signal is processed by a beam-forming digital signal processor 66.

When the switch 40 is in the transmit mode, the digital signal processor 66 provides a digital signal to be transmitted to the summer 64 that is distributed to the several weighting junctions 62 in the various channels 36 so as to provide the desired weighting to the transmit signal for beam-forming and directional purposes. The digital signal from the weighting junction 62 is then sent to a digital-to-analog (D/A) converter 70, provided on the digital chip 34, in the transmit side of the channel 36. The analog signal from the D/A converter 70 is then sent to a band-pass filter 72 to filter the signal to be within the desired frequency band. The filtered signal from the band-pass filter 72 is then sent to a mixer 74 for frequency up-conversion purposes to convert the signal to a high frequency signal for transmission. The mixer 74 receives a frequency signal from a local oscillator (LO) 76 to provide the up-conversion. The high frequency signal from the mixer 74 is then filtered by another band-pass filter 78 and amplified by an LNA 80. A power amplifier 82 then amplifies the high frequency signal that is sent to the antenna 38 for transmission purposes.

The amplifiers 42, 52, 80 and 82 can include MEMS tunable matching networks that can tune the response of the amplifiers. Particularly, a broadband amplifier can be used, and it can be tuned to different bands by tuning the MEMS matching network. Further, the band pass filters 50, 72 and 78 can be MEMS tunable band-pass filters. Additionally, evanescent mode filters can be used for the band-pass filters 50, 72 and 78, which can also be tunable.

As is well understood in the art, each digital signal, whether a receive signal or transmit signal, would include both an in-phase portion and a quadrature-phase portion. Further other transceiver components, such as low-pass filters and amplifiers, may be provided in the transceiver array 30 depending on the specific application.

Figure 1:
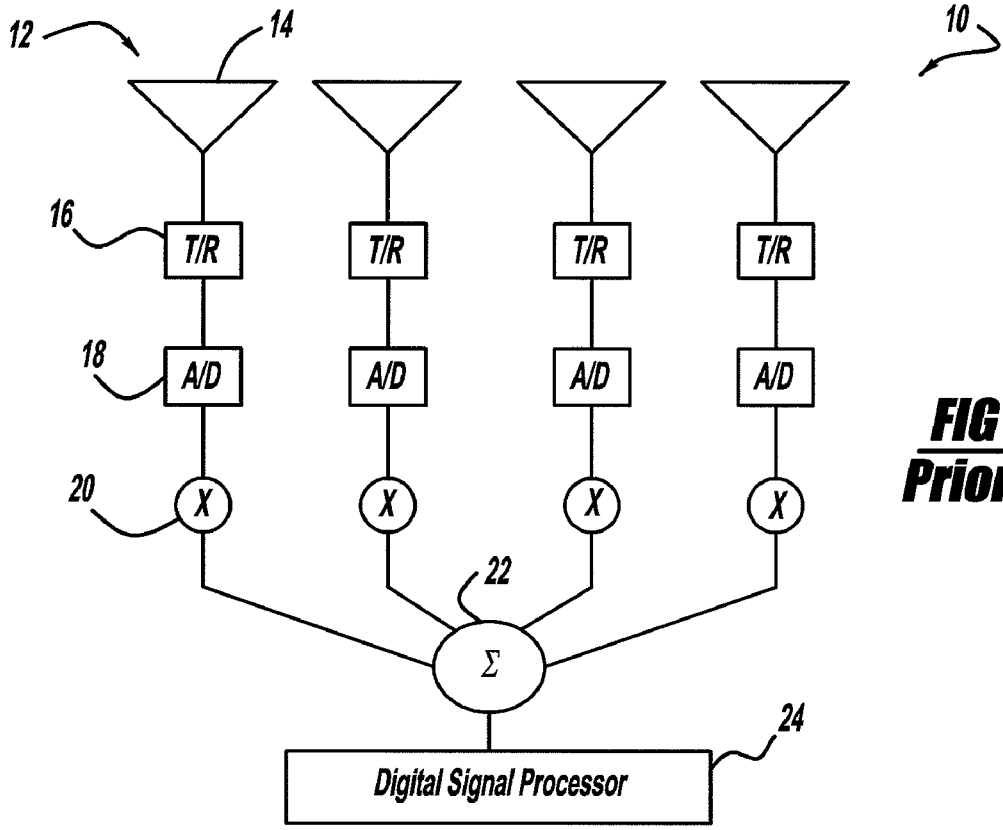
FIG - 1 Prior Art
FIG. 1 is a schematic block diagram of a known transceiver array that employs digital beam-forming.
Figure 3:
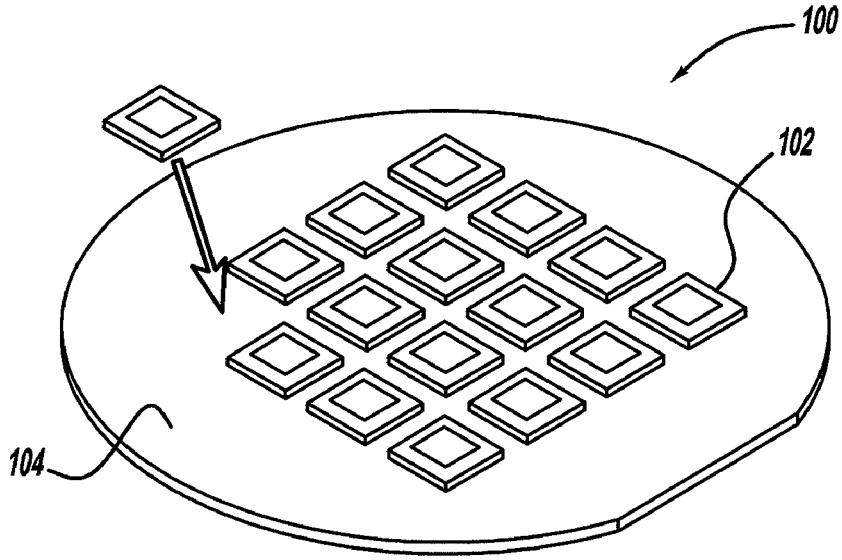
FIG. 3 is a perspective view of a transceiver array that includes a plurality of integrated radio frequency (RF) cubes formed to a digital wafer, according to another embodiment of the present invention.

FIG. 3 is a perspective view of an RF transceiver array 100, according to another embodiment of the invention. The array 100 includes a plurality of vertically integrated RF cubes 102, where each RF cube 102 is for a separate RF channel and includes vertically integrated components, such as those in the wafers 32 discussed above. The term "cube" is used herein for convenience purposes only in that the RF cubes 102 can have any configuration suitable for the purposes described herein. The several RF cubes 102 are formed to a digital wafer 104, representing the wafer 34, by any suitable semiconductor fabrication process. A plurality of the RF cubes 102 would be fabricated together on a common wafer, and diced from the wafer to separate the RF cubes. The digital wafer 104 can be any suitable wafer for the purposes described herein, such as a complimentary metal oxide semiconductor (CMOS) wafer or a printed circuit board. In this non-limiting embodiment, the array 100 includes sixteen RF cubes 102 providing a sixteen-channel transceiver. However, the number of the RF cubes 102 would be application specific, and would increase or decrease the gain of the array 100.

Figure 4:
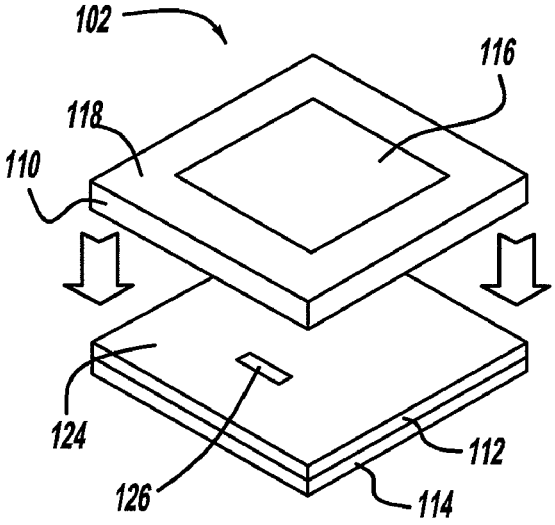
FIG. 4 is an exploded top perspective view of one of the RF cubes shown in FIG. 3.
Figure 5:
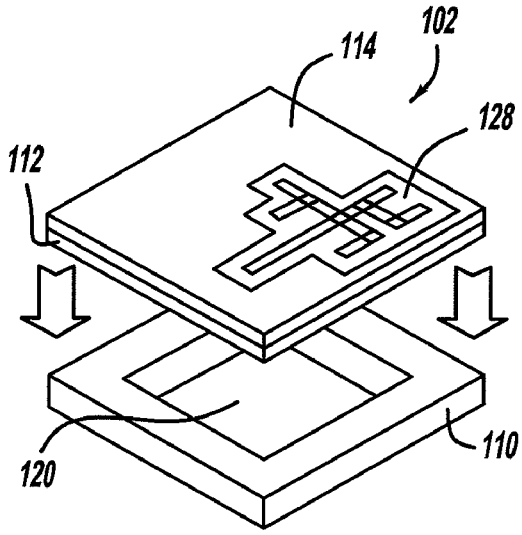
FIG. 5 is an exploded bottom perspective view of one of the RF cubes shown in FIG. 3.

FIG. 4 is an exploded top perspective view and FIG. 5 is an exploded bottom perspective view of one of the RF cubes 102. In this non-limiting embodiment, the RF cube 102 includes three wafers, particularly, an antenna wafer 110 and monolithic millimeter-wave integrated circuit (MMIC) wafers 112 and 114. The antenna wafer 110 includes a patch antenna 116, representing the antenna 38, deposited and patterned on a top surface 118 of the patch antenna wafer 110. The size of the patch antenna 116 determines the frequency of the transmit and receive signal and the size of the RF cube 102. Particularly, the face area of the RF cube 102 is determined by the size of the patch antenna 110, which is set by the frequency of the system. Higher frequency systems would typically require smaller antennas, and vice versa. An underside of the patch wafer 110 includes an antenna cavity 120 that allows the transmit signal or the receive signal to resonate at the desired frequency for transmission or reception purposes.

Although the specific embodiment for the RF cube 102 shows the patch antenna 116, the present invention contemplates any suitable antenna for any of the applications discussed herein. For example, other types of antennas may be applicable including printed dipoles, printed Vivaldi antennas, (PIFA), slot antennas, spiral antennas, loop antennas, printed inverted F antennas, etc. Further, the configuration of the patch antenna 116, or any of the other antennas mentioned above, can be both linearly and circularly polarized.

The MMIC wafer 112 includes a metallized or back plane layer 124 having a feed slot 126 formed therethrough. The receive signal resonates within the cavity 120 and propagates through the feed slot 126 and is received by an RF MMIC circuit 128 formed on the MMIC wafer 114. Likewise, the transmit signal is sent through the feed slot 126 from the circuit 128 to resonate within the cavity 120 to be transmitted by the patch antenna 116. The MMIC circuit 126 includes the various circuits in the wafers 32.

The RF MMIC circuit 128 is intended to represent any RF integrated circuit or circuits fabricated on the wafers 112 and 114 that are compatible with silicon and III-V semiconductor wafers. For example, the RF MMIC circuit 128 can include microelectro-mechanical switches or other microelectro-mechanical systems. RF MEMS components provide tunability, such as tunable matching networks for amplifiers and tunable filters, and therefore result in tunable RF cubes which can be used in a multi-band digital beam forming array. Further, the RF cube architecture disclosed herein can be integrated on-wafer with an evanescent mode filter to allow for a complete, high performance, wafer-scale, transmit/receive, tunable module for digital beam forming arrays. Combining a tunable high-cube evanescent mode filter with the RF cube 120 on-wafer results in a high-performance architecture because these types of evanescent mode filters can be used to isolate the RF from the local oscillator signal and the intermediate frequency signal at the mixers, and also eliminate all of the higher harmonics generated by the active elements of the circuit.

Figure 6:
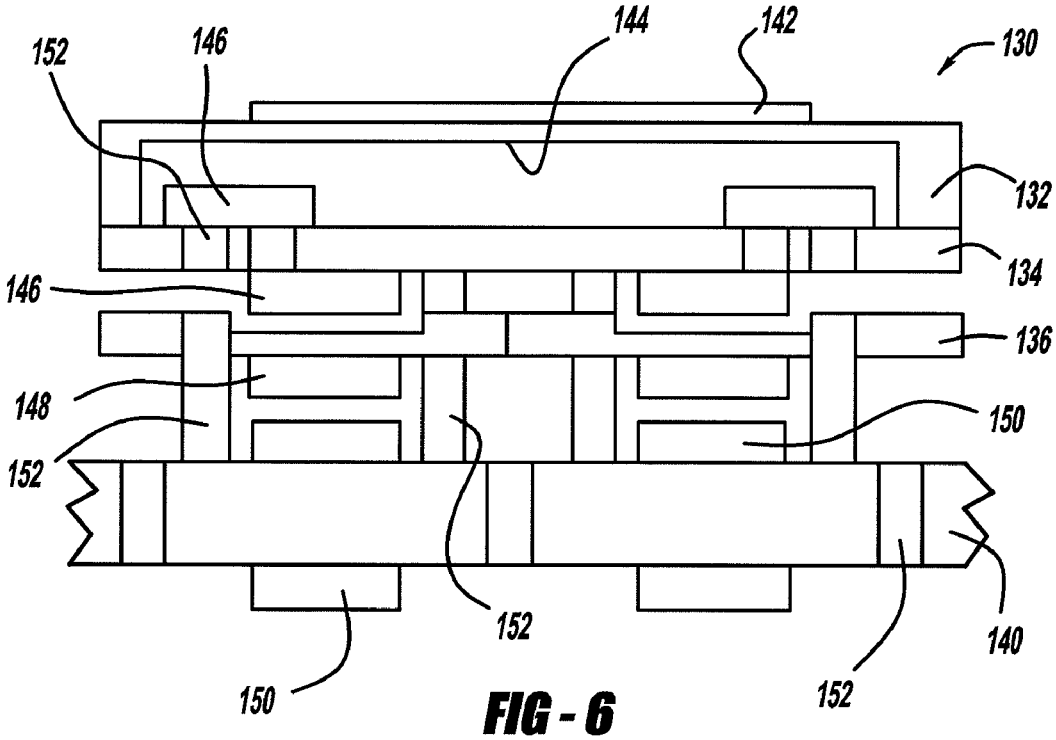
FIG. 6 is a cross-sectional view of an RF cube and digital wafer, according to an embodiment of the present invention.

FIG. 6 is a cross-sectional view of a vertically integrated RF transceiver module 130 of the type discussed above, according to another embodiment of the present invention. The transceiver module 130 is similar to the RF cube 102 and shows a more detailed placement of circuit and RF components on the various wafers. The module 130 includes an antenna RF wafer 132, a lower RF wafer 134 and an intermediate frequency RF wafer 136 that would be part of an RF cube of the type described above. Further, the module 130 includes a digital beam-forming wafer 140, where a plurality of the separate antenna wafers and lower RF wafers would be formed thereon as discussed above.

An antenna 142 is deposited on a top surface of the antenna wafer 132, and a resonating cavity 144 is formed within the wafer 132. The antenna 142 is intended to represent any of the antennas referred to above. RF integrated circuits 146 are provided on both sides of the lower RF wafer 134 and include integrated circuit components as discussed above. Any one of the integrated circuits 146 can be an RF MEMS integrated in the transceiver module 130, as discussed above. Further, IF integrated circuits 148 are provided on a bottom surface of the intermediate frequency RF wafer 136, where the IF integrated circuits 148 include the IF components in the transceiver array. Digital integrated circuits 150 are provided on both sides of the digital wafer 140. Various RF vias 152, typically made of gold (AU), extend through the various wafers 132-140, as shown, to provide the electrically coupling between the various circuits.

Figure 7:
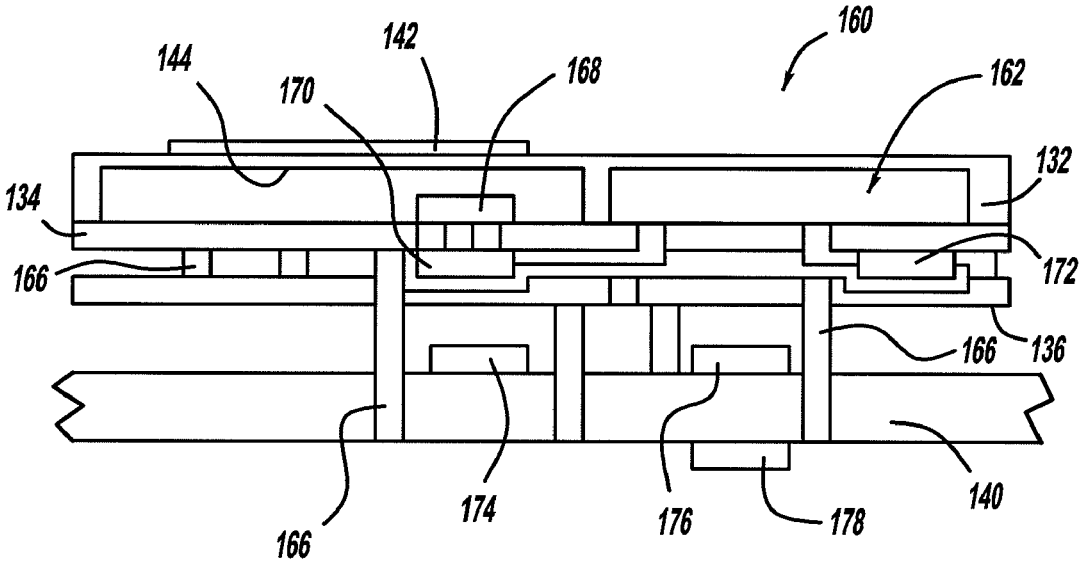
FIG. 7 is a cross-sectional view of an RF cube and digital wafer, according to another embodiment of the present invention.

FIG. 7 is a cross-sectional view of a vertically integrated RF transceiver module 160 of the type discussed above, according to another embodiment of the present invention, where like elements to the transceiver module 130 are identified by the same reference numeral. The transceiver module 160 only shows the components for the receive side of the transceiver. The module 160 includes an evanescent mode band-pass filter 162, that can be tunable to the particular frequency band of interest. A suitable evanescent mode band-pass filter for this purpose is described in U.S. patent application Ser. No. 11/735,269, titled Evanescent Mode Resonator Including Tunable Capacitive Post, filed Apr. 13, 2007, publication no. 2008/0252401, now abandoned, assigned to the Assignee of this application. The transceiver module 160 includes RF vias and bumps 164 for interconnecting the circuits in the wafers 132, 134, 136 and 140. A low noise amplifier 168 is provided within the cavity 144, and a mixer 170 is provided on an opposite surface of the wafer 134 from the wafer 132, as shown. Further, a driver amplifier 172 is provided on the surface of the wafer 134 opposite to the wafer 132. A digital signal processing band-pass filter 174 and an analog-to-digital converter 176 are formed on the digital wafer 140 facing the wafer 136, and an integrated circuit digital control 178 is provided on an opposite surface of the digital wafer 140.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A transceiver array comprising: a digital wafer including digital integrated circuits; and a plurality of RF cubes formed to the digital wafer, each of the RF cubes including a plurality of integrated circuit wafers "including" wherein the plurality of integrated circuit wafers include an antenna wafer and at least one lower wafer, said antenna wafer including an antenna and a resonating cavity and said lower wafer including a least one integrated circuit.

2. The array according to claim 1 wherein the at least one lower wafer includes high frequency integrated MMIC circuits.

3. The array according to claim 2 wherein the high frequency integrated MMIC circuits include low-noise amplifiers, band-pass filters and mixers.

4. The array according to claim 3 wherein the low-noise amplifiers and the band-pass filters include a MEMS tunable matching network.

5. The array according to claim 2 wherein the high frequency integrated MMIC circuits include a microelectro-mechanical switch.

6. The array according to claim 1 wherein the at least one lower wafer includes intermediate frequency integrated circuits.

7. The array according to claim 6 wherein the intermediate frequency integrated circuits include amplifiers and band-pass filters.

8. The array according to claim 7 wherein the amplifiers and band-pass filters include a MEMS tunable matching network.

9. The array according to claim 1 wherein the at least one lower wafer is a first lower wafer that covers the resonating cavity and a second lower wafer that is provided between the first lower wafer and the digital wafer.

10. The array according to claim 1 wherein each of the plurality of the RF cubes includes at least one evanescent mode filter.

11. The array according to claim 10 wherein the evanescent mode filter is tunable.

12. The array according to claim 1 wherein the digital integrated circuits include analog-to-digital converters and digital-to-analog converters.

13. The array according to claim 1 wherein the antenna is selected from the group consisting of patch antennas, printed dipole antennas, slot antennas, spiral antennas, loop antennas, planar inverted F antennas and Vivaldi antennas.

14. The array according to claim 1 wherein the antenna wafer and the at least one lower wafer are silicon wafers.

15. The array according to claim 1 wherein the digital wafer is a CMOS wafer.

16. The array according to claim 1 wherein the digital wafer is a printed circuit board carrier.

17. The array according to claim 1 further comprising weighting junctions and a digital beam-forming processor provided on the digital wafer.

18. The array according to claim 1 wherein the antenna is both linearly and circularly polarized.

19. A vertically integrated RF circuit comprising:

an antenna wafer having a first surface and a second surface, said antenna wafer including an antenna formed to the first surface and a resonating cavity formed through the second surface;

a first RF wafer covering the resonating cavity and including at least one integrated circuit; and a second RF wafer electrically coupled to the first RF wafer, said second RF wafer including at least one integrated circuit.

20. The integrated RF circuit according to claim 19 wherein the first RF wafer includes high frequency integrated circuits and the second RF wafer includes intermediate frequency integrated circuits.

21. The integrated RF circuit according to claim 19 wherein the antenna is a patch antenna.

22. The array according to claim 19 wherein the high frequency integrated MMIC circuits include an RF micro-electro-mechanical switch.

23. The array according to claim 19 wherein each of the plurality of the RF cubes includes an evanescent mode filter.

24. The array according to claim 23 wherein the evanescent mode filter is tunable.

25. The integrated RF circuit according to claim 19 wherein the integrated RF circuit is a channel in a transceiver array.

26. The integrated RF circuit according to claim 25 wherein the transceiver array is a digital beam-forming transceiver array.

27. The array according to claim 19 wherein the antenna wafer and the first and second wafers are silicon wafers.

28. A transceiver array that provides digital beam-forming for both transmit and receive signals, said transceiver array comprising:

a digital wafer including analog-to-digital converters, digital-to-analog converters, weighting junctions and a digital beam-forming processor; and a plurality of RF cubes formed to the digital wafer where each RF cube is a channel in the array, each of the RF cubes including an antenna wafer, a first lower wafer and a second lower wafer, said antenna wafer including a patch antenna and a resonating cavity, said first lower wafer covering the resonating cavity and including high frequency RF MMIC integrated circuits and said second lower wafer including intermediate frequency integrated MMIC circuits.

29. The array according to claim 28 wherein the antenna wafer and the first and second lower wafers are silicon wafers.

30. The array according to claim 28 wherein the digital wafer is a CMOS wafer.

31. The array according to claim 28 wherein the antenna is both linearly and circularly polarized.

* * * * *